US007496306B2

(12) United States Patent
Izumi et al.

(10) Patent No.: US 7,496,306 B2
(45) Date of Patent: Feb. 24, 2009

(54) CLEANING METHOD FOR TRANSFER DEVICE OF IMAGE FORMING APPARATUS

(75) Inventors: Takao Izumi, Yokohama (JP); Masato Ogasawara, Katsushika-ku (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 351 days.

(21) Appl. No.: 11/367,129

(22) Filed: Mar. 3, 2006

(65) Prior Publication Data

US 2007/0206970 A1 Sep. 6, 2007

(51) Int. Cl.
*G03G 15/16* (2006.01)

(52) U.S. Cl. ..... 399/66; 399/101

(58) Field of Classification Search ..... 399/66, 399/101, 299, 302, 313
See application file for complete search history.

(56) References Cited

U.S. PATENT DOCUMENTS 5,621,509 A * 4/1997 Karashima et al. ..... 399/66
6,173,135 B1 * 1/2001 Yuminamochi et al. ..... 399/66
6,341,205 B1 * 1/2002 Yoshino et al. ..... 399/101
6,766,125 B1 7/2004 Izumi
6,898,393 B2 * 5/2005 Kawamura ..... 399/101
7,035,563 B2 * 4/2006 Sawada ..... 399/66

FOREIGN PATENT DOCUMENTS

JP 2004-004283 1/2004

* cited by examiner

*Primary Examiner*—William J Royer
(74) *Attorney, Agent, or Firm*—Amin, Turocy & Calvin, LLP

(57) ABSTRACT

A constant current output is applied to a backup roller or a secondary transfer member, and a cleaning bias is controlled according to a measurement obtained by monitoring a voltage generated at that time. Cleaning biases of a plus polarity and a minus polarity are alternately applied to the backup roller to recover the toner adhered on the secondary transfer member to an intermediate transfer belt. The cleaning bias is controlled according to the combined resistance of a secondary transfer section which is varied with not only the environment of an image forming apparatus, but also the condition of use and various factors to recover the toner adhered to the secondary transfer member to the intermediate transfer belt without fail, thereby preventing smudges on the back of a sheet of paper or smudges on images.

9 Claims, 3 Drawing Sheets

FIG. 4
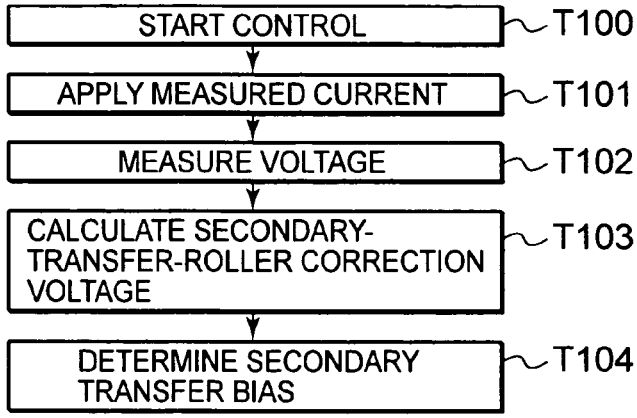
FIG. 5
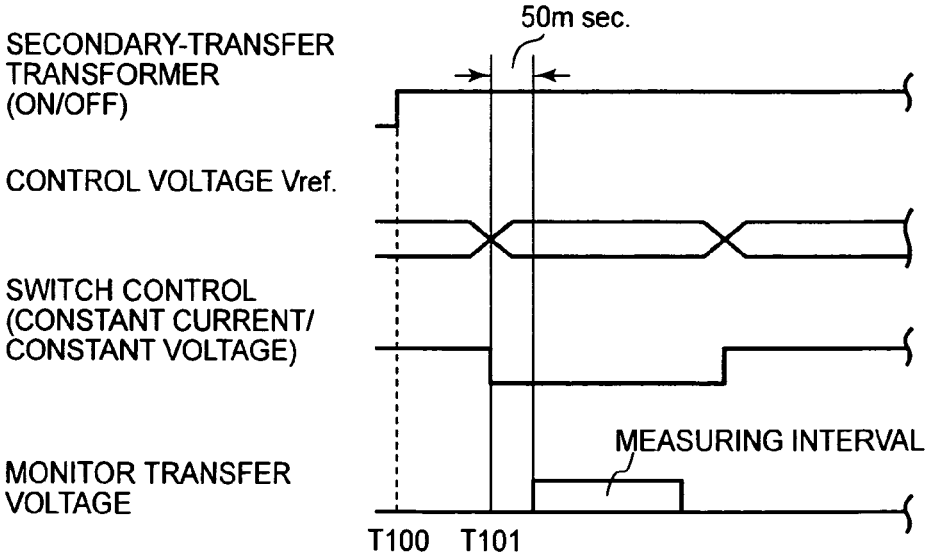
FIG. 6
| MEASURED VOLTAGE (V) MONITOR BIAS (V) | SECONDARY-TRANSFER-ROLLER CLEANING BIAS (V) |
|---|---|
| 300 | 400 |
| 700 | 933 |
| 1000 | 1333 |
| 2000 | 2667 |
| 3000 | 4000 |
| 4000 | 5333 |

CLEANING METHOD FOR TRANSFER DEVICE OF IMAGE FORMING APPARATUS

BACKGROUND OF THE INVENTION

1. Field of the Invention

The present invention relates to image forming apparatuses for use in electrophotographic copying machines and color printers, in which the toner adhered to transfer members is removed.

2. Description of the Related Art

Some image forming apparatuses of copying machines and printers have a transfer member that comes into contact with an opposed image bearing member to transfer toner images formed on the image bearing member. The apparatuses pass a sheet of paper between the image bearing member and the transfer member, and form an electric field between the image bearing member and the transfer member to transfer the toner image on the image bearing member onto the sheet of paper.

However, in this transfer system, without a sheet of paper between the image bearing member and the transfer member, the transfer member comes into direct contact with the image bearing member to cause the toner to adhere to the transfer member, smudging the surface of the transfer member. Specifically, toner adhered by paper jamming, fog toner on the image bearing member, or the toner of test images such as resist marks may adhere to the transfer member to smudge the surface of the transfer member. The toner adhered to the transfer member will smudge the back of the sheet of paper during the succeeding transfer or, for both-side printing, will smudge the surface of the images.

Therefore, some known apparatuses apply a bias voltage to the image bearing member or the transfer member during handling of paper jamming to form an electric field between the image bearing member and the transfer member, thereby recovering the toner adhered to the transfer member to the image bearing member. With those apparatuses, the resistances of the image bearing member and the transfer member vary with the change of environment. Accordingly, to apply a more suitable bias voltage to the image bearing member or the transfer member, the known apparatuses have controlled the bias voltage to be applied to the image bearing member or the transfer member according to the measurements by a temperature and humidity sensor.

However, the resistances of the image bearing member and the transfer member are influenced not only by the changes of temperature and humidity but also by the frequency or condition of use of the apparatuses. For example, the surface characteristic of the image bearing member or the transfer member changes by continuous transfer, double-sided transfer, or the like to cause the changes of the resistances. Accordingly, there is the possibility that a bias voltage necessary for recovering the toner adhered on the transfer member to the image bearing member cannot be obtained even when the bias voltage is controlled according to the measurements by the temperature and humidity sensor. Accordingly, the toner adhered on the surface of the transfer member may not be sufficiently recovered, causing smudges on the back of a sheet of paper or images.

Accordingly, it is desired for image forming apparatuses that transfer images by bringing an image bearing member and a transfer member into contact with each other to prevent smudges on the back of recording media or images without fail by smoothly recovering the toner adhered to the transfer member.

SUMMARY OF THE INVENTION

According to an aspect of the invention, there is provided an image forming apparatus that passes a recording medium between an image bearing member and a transfer member to thereby transfer toner images on the image bearing member onto the recording medium, in which toner adhered to the transfer member is recovered to the image bearing member without fail. With this arrangement, smudges on the back of the recording medium or images are prevented, thereby ensuring a high-quality toner image.

An image forming apparatus according to an embodiment of the invention includes: an image bearing member; a transfer member opposed to the image bearing member; a bias applying member that applies a cleaning bias to the transfer member or the image bearing member; and a control member that controls the cleaning bias according to the combined resistance of the image bearing member and the transfer member.

BRIEF DESCRIPTION OF THE DRAWINGS

FIG. 4 is a transition diagram of cleaning bias control according to the embodiment of the invention;

FIG. 5 is a timing chart of correction control according to the embodiment of the invention; and FIG. 6 is a cleaning bias table according to the embodiment of the invention.

DETAILED DESCRIPTION OF THE EMBODIMENT

Figure 1:
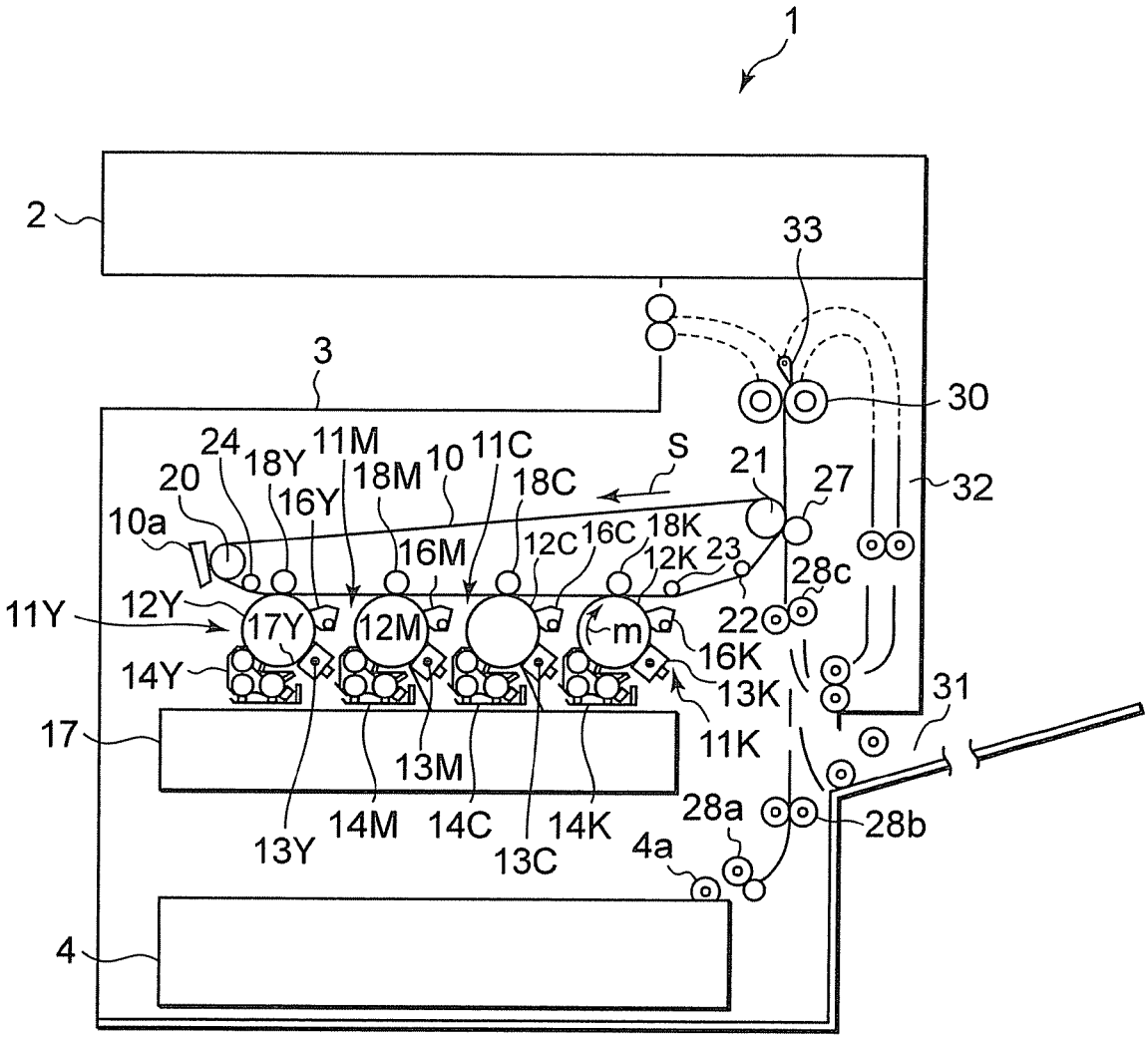
FIG. 1 is a schematic diagram of a color copying machine according to an embodiment of the invention.

An embodiment of the invention will be specifically described with reference to the accompanying drawings. FIG. 1 is a schematic diagram of a color copying machine 1 of a four-connection tandem system, which is an image forming apparatus according to an embodiment of the invention. The color copying machine 1 includes a scanner 2 and an in-machine output section 3 at the upper part. The color copying machine 1 also includes four image forming units 11Y, 11M, 11C, and 11K of yellow (Y), magenta (M), cyan (C), and black (K) which are juxtaposed along the lower side of an endless intermediate transfer belt 10.

The image forming units 11Y, 11M, 11C, and 11K have photoconductor drums 12Y, 12M, 12C, and 12K of a diameter of 30 mm, respectively. Around each of the photoconductor drums 12Y, 12M, 12C, and 12K, there are disposed chargers 13Y, 13M, 13C, and 13K, developer units 14Y, 14M, 14C, and 14K, and photoconductor-drum cleaning units 16Y, 16M, 16C, and 16K, respectively, in the rotating direction along the arrow m. Laser light from a laser exposure unit 17 is radiated to the interval from the chargers 13Y, 13M, 13C, and 13K through the developer units 14Y, 14M, 14C, and 14K around the photoconductor drums 12Y, 12M, 12C, and 12K to form electrostatic latent images on the photoconductor drums 12Y, 12M, 12C, and 12K.

The chargers 13Y, 13M, 13C, and 13K evenly charge the surfaces of the photoconductor drums 12Y, 12M, 12C, and 12K, respectively, to, for example, about −600 V. The developer units 14Y, 14M, 14C, and 14K have a dual-component developer containing a toner of yellow (Y), magenta (M), cyan (C), and black (M), respectively, and a carrier, and provide toners of a minus polarity to the electrostatic latent images on the photoconductor drums 12Y, 12M, 12C, and 12K for reverse development.

The laser exposure unit 17 scans laser beams emitted from a semiconductor laser device along the axes of the photoconductor drums 12Y, 12M, 12C, and 12K to form images on the photoconductor drums 12BK, 12Y, 12M, and 12C through an imaging lens system.

The intermediate transfer belt 10 is stretched around a backup roller 21 which is a backup member and for driving, a driven roller 20, and first to third tension rollers 22 to 24. The intermediate transfer belt 10 is in contact with the opposed photoconductor drums 12Y, 12M, 12C, and 12K. Primary transfer rollers 18Y, 18M, 18C, and 18K are disposed in the primary transfer positions of the intermediate transfer belt 10 opposed to the photoconductor drums 12Y, 12M, 12C, and 12K, respectively. The primary transfer rollers 18Y, 18M, 18C, and 18K primarily transfer the toner images on the photoconductor drums 12Y, 12M, 12C, and 12K to the intermediate transfer belt 10 by the application of primary transfer voltages of about +1,000 V, +1,200 V, +1,400 V, and +1,600 V in sequence.

A secondary transfer roller 27 serving as a transfer member is disposed at a secondary transfer section supported by the backup roller 21 of the intermediate transfer belt 10. The intermediate transfer belt 10 and the backup roller 21 configure an image bearing member. The secondary transfer roller 27 can move into and out of contact with the intermediate transfer belt 10. A predetermined secondary transfer bias is applied to the secondary transfer section by the backup roller 21. Thus a transfer electric field is formed at the secondary transfer section between the intermediate transfer belt 10 and the secondary transfer roller 27, whereby the toner images on the intermediate transfer belt 10 are secondarily transferred onto a sheet of paper that passes between the intermediate transfer belt 10 and the secondary transfer roller 27.

A belt cleaner 10*a* is disposed downstream from the secondary transfer roller 27 of the intermediate transfer belt 10. The intermediate transfer belt 10 is made of, for example, polyimide with a thickness of 100 μm in which carbons are uniformly dispersed. The intermediate transfer belt 10 has an electrical resistance of $10^9$ Ωcm and semiconductivity.

The material of the intermediate transfer belt 10 is preferably a semiconductor with a volume resistivity of $10^8$ to $10^{11}$ Ωcm; for example, in place of the polyimide containing dispersed carbon, polyethylene terephthalate, polycarbonate, polytetrafluoro ethylene, and polyvinylidene fluoride containing dispersed conductive particles such as carbon are possible. Alternatively, a polymeric film may be used whose electrical resistivity is controlled by varying components without using the conductive particles. Furthermore, a polymeric film containing an ionic conductive material or a rubber material with a relatively low electrical resistivity, such as silicon or urethane rubber, may be used.

Figure 2:
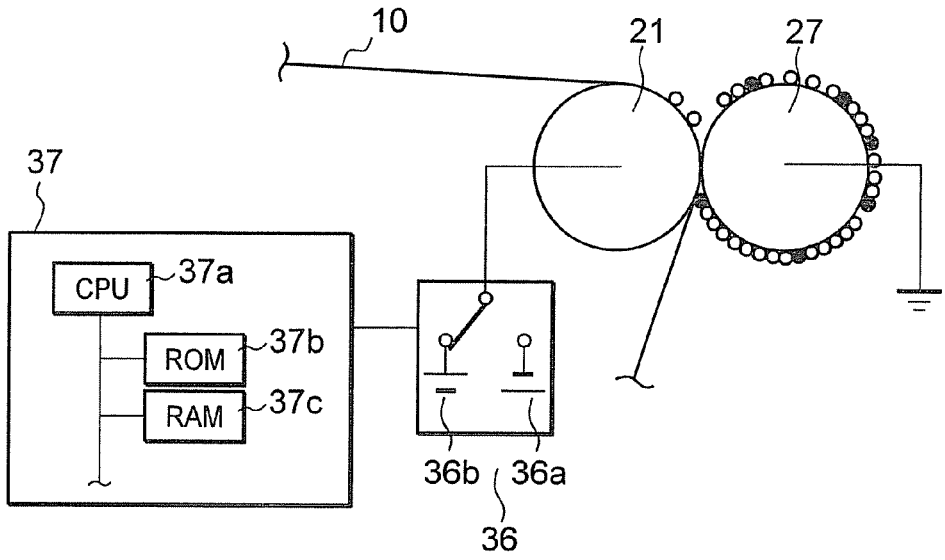
FIG. 2 is a schematic explanatory diagram of a secondary transfer section and a control system thereof according to the embodiment of the invention.

For example, the secondary transfer roller 27 is a 28-mm-outside-diameter epichloro-rubber sponge coated with an epichloro rubber tube. The secondary transfer roller 27 has a rubber hardness of 25 to 30 degrees (Asker C) and a volume resistivity of $10^7$ Ω. The backup roller 21 is, for example, an electrically grounded aluminum roller. As shown in FIG. 2, the backup roller 21 connects to a power source 36. The power source 36 configures a bias applying member. The power source 36 includes a first applying section 36*a* that applies a minus cleaning bias and a second applying section 36*b* that applies a plus cleaning bias.

During the secondary transfer, the power source 36 applies a predetermined transfer bias to the backup roller 21 to generate an electric field between the intermediate transfer belt 10 and the secondary transfer roller 27, for secondarily transferring the toner image on the intermediate transfer belt 10 onto a sheet of paper. On the other hand, during the cleaning, the power source 36 applies a predetermined cleaning bias whose polarity is alternately switched between a plus polarity and a minus polarity to the backup roller 21. Thus the toner adhered on the secondary transfer roller 27 charged in a plus polarity or a minus polarity can be recovered to the intermediate transfer belt 10.

A paper feeding section 4 which feeds a sheet of paper toward the secondary transfer roller 27 is disposed below the laser exposure unit 17. A manual feed mechanism 31 for manually feeding a sheet of paper is disposed on the right of the color copying machine 1. Between the paper feeding section 4 and the secondary transfer roller 27, a pickup roller 4*a*, a separating roller 28*a*, a feed roller 28*b*, and a resist roller 28*c* are disposed. A fusing unit 30 is disposed downstream from the secondary transfer roller 27 in the forward direction in which a sheet of paper is conveyed from the paper feeding section 4 to the secondary transfer roller 27.

A gate 33 is disposed downstream from the fusing unit 30, which distributes a sheet of paper to the in-machine output section 3 or a refeeding unit 32. The refeeding unit 32 conveys a sheet of paper that has passed through the fusing unit 30 to the secondary transfer roller 27 again.

The image forming unit 11Y includes a processing unit in which the photoconductor drum 12Y and a processing means are integrated, and is detachable from the body of the image forming apparatus. The processing means including at least one of the charger 13Y, the developer unit 14Y, and the photoconductor-drum cleaning unit 16Y. The image forming units 11M, 11C, and 11K also have the same structure as the image forming unit 11Y, and are detachable, as processing units, from the image forming apparatus.

The operation will next be described. Upon starting an image forming process, image information is input from the scanner 2, a computer terminal, or the like. Thus the photoconductor drums 12Y, 12M, 12C, and 12K are rotated to start the steps of image formation by the image forming units 11Y, 11M, 11C, and 11K in sequence.

In the yellow image forming unit 11Y, the surface of the photoconductor drum 12Y is charged evenly by the charger 13Y. The photoconductor drum 12Y is then irradiated with a laser beam corresponding to yellow image information at an exposure position 17Y to form an electrostatic latent image. Then the developer unit 14Y develops a toner image on the photoconductor drum 12Y. The photoconductor drum 12Y comes into contact with the intermediate transfer belt 10 rotated in the direction of an arrow S to primarily transfer the toner image onto the intermediate transfer belt 10 with the primary transfer roller 18Y.

The magenta image forming unit 11M, the cyan image forming unit 11C, and the black image forming unit 11K also execute toner-image forming processes as in the yellow toner-image forming process. The toner images formed on the photoconductor drums 12M, 12C, and 12K are transferred in sequence on the same position on the intermediate transfer belt 10 at which the yellow toner image is formed. Thereafter, the full-color toner image of yellow, magenta, cyan, and black which is multiple-transferred on the intermediate transfer belt 10 reaches the secondary transfer section where the secondary transfer roller 27 is opposed.

At that time, the sheet of paper is conveyed between the intermediate transfer belt 10 and the secondary transfer roller 27 in synchronization with the full-color toner image. Thus the full-color toner image on the intermediate transfer belt 10 is secondary-transferred collectively onto the sheet of paper owing to the transfer bias applied to the backup roller 21. The sheet of paper is then subjected to heat and pressure by the fusing unit 30 to complete a toner image. After the fusing, the sheet of paper passes through the gate 33 and, for single-sided printing, the sheet of paper is output to the in-machine output section 3; for double-sided printing, it is reconveyed to the position of the secondary transfer roller 27 through the refeeding unit 32.

On the other hand, after completion of the secondary transfer, the residual toner on the intermediate transfer belt 10 is cleaned by the belt cleaner 10*a*. The residual toners on the photoconductor drums 12Y, 12M, 12C, and 12K is removed by the photoconductor-drum cleaning units 16Y, 16M, 16C, and 16K, respectively, after the primary transfer of the toner images onto the intermediate transfer belt 10, thus allowing the next image forming process.

When a sheet of paper jam occurs during the image forming process, the power source 36 applies a predetermined transfer bias to the backup roller 21 without the sheet of paper at a transfer position between the intermediate transfer belt 10 and the secondary transfer roller 27. The full-color toner image on the intermediate transfer belt 10 is therefore transferred to the secondary transfer roller 27. The toner adhered to the secondary transfer roller 27 will smudge the back of the sheet of paper during the next transfer or smudge images during double-sided printing, thus reducing the image quality. In this embodiment, most of the toners adhered to the secondary transfer roller 27 have a minus polarity.

After the paper jam is cleared, the color copying machine 1 performs a returning operation for cleaning the secondary transfer roller 27 after a front cover (not shown) is closed. The returning operation is a cleaning operation for recovering the toner adhered to the secondary transfer roller 27 to the intermediate transfer belt 10. The cleaning operation at the secondary transfer section will be specifically described. The cleaning operation at the secondary transfer section is executed by the application of a predetermined cleaning bias to the backup roller 21 by the power source 36, whose polarity is switched alternately between a plus polarity and a minus polarity. The toner adhered on the secondary transfer roller 27 charged to a plus polarity or a minus polarity is thus recovered to the intermediate transfer belt 10.

However, the combined resistance at the secondary transfer section (the resistance of the backup roller 21+ the resistance of the intermediate transfer belt 10 + the resistance of the secondary transfer roller 27) varies depending on the condition of use of the color copying machine 1 or environmental variation. The variations in the combined resistance due to the condition of use include variations due to increases in temperature of the components during continuous transfer and variations due to the changes in characteristics of the components. Accordingly, during a cleaning operation, the cleaning bias must be controlled according to the variations in the combined resistance of the secondary transfer section.

Figure 3:
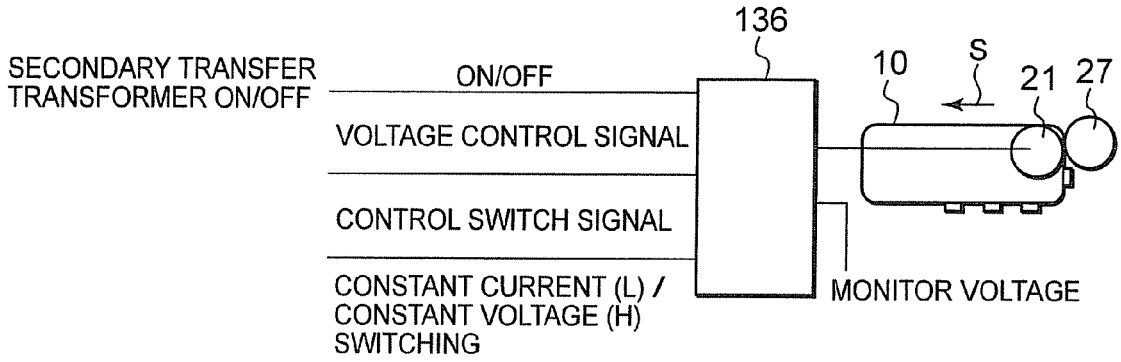
FIG. 3 is a schematic block diagram of a cleaning-bias control system according to the embodiment of the invention.

The control of the cleaning bias to be applied to the backup roller 21 will next be described. FIG. 3 shows a control block for controlling the cleaning bias to be applied to the backup roller 21. A controller 37 has a CPU 37*a* which has a ROM 37*b* and a RAM 37*c* as memory devices. A secondary transfer transformer 136 that configures a control unit together with the controller 37 (FIG. 2) has three inputs and two outputs. The inputs are for an ON/OFF signal for the secondary transfer transformer 136, a voltage control signal for controlling the output level of the secondary transfer transformer 136, and a control switch signal for switching between a constant current control and a constant voltage control. The outputs are for a cleaning bias or current to be applied to the backup roller 21 and a cleaning-bias monitor voltage.

The control transition diagram of FIG. 4 and the time chart of FIG. 5 show a control of detecting variations in voltage due to changes in combined resistance at the secondary transfer section. First, a cleaning bias table for reference in calculating a cleaning bias is prepared. The cleaning bias table is prepared for various combined resistances of the secondary transfer section. When the intermediate transfer belt 10 is driven at a predetermined combined resistance, and when it is confirmed that the secondary transfer roller 27 is in contact with the intermediate transfer belt 10, the secondary transfer transformer 136 is turned on to start the control (T100). The secondary transfer transformer 136 is switched to a constant current output in response to a control switch signal. A control voltage is set so as to provide a predetermined current, and a predetermined constant current output (e.g., +30 μA) is applied to the backup roller 21 from the secondary transfer transformer 136 (T101). The voltage generated at that time is output as a monitor voltage from the secondary transfer transformer 136. The monitor voltage is specified by the combined resistance of the secondary transfer section.

When the constant current output applied to the backup roller 21 from the secondary transfer transformer 136 becomes stable, the monitor voltage is measured. The time after the application of the constant current output to the measurement of the monitor voltage is about 50 msec. It is preferable that the interval to measure the monitor voltage be an interval during which the secondary transfer roller 27 makes one rotation or more. However it is not limited to that. For example, assuming that the diameter of the secondary transfer roller 27 is 28 mm, the processing speed is 150 mm/sec, and the sampling period is 24 msec, the number of samplings during the measuring interval that the secondary transfer roller 27 makes one rotation is approximately 24.

The sampled monitor voltages are averaged into a measured voltage (T102). The steps of T101 and T102 are executed for predetermined six combined resistances. The relationship between six measured voltages obtained in T102 and the cleaning biases, which are the control voltages set so as to obtain predetermined currents in T101, is presented in a cleaning bias table. An example of the cleaning bias table is shown in FIG. 6. FIG. 6 indicates that when the measured voltage obtained from the monitor voltage is 300V, the cleaning bias is 400 V; when the measured voltage is 700 V, the cleaning bias is 933 V; when the measured voltage is 1,000 V, the cleaning bias is 1,333 V; when the measured voltage is 2,000 V, the cleaning bias is 2,667 V; when the measure voltage is 3,000 V, the cleaning bias is 4,000 V; and when the measured voltage is 4,000 V, the cleaning bias is 5,333 V according to the combined resistance of the secondary transfer section. The cleaning bias table is stored in a ROM 37*b* of the controller 37 in advance.

The controller 37 then controls the returning operation after handling the jam. First a constant current output is applied to the backup roller 21 in T101 of FIG. 4. The voltage generated at that time is output as a monitor voltage from the secondary transfer transformer 136. The sampling of the monitor voltage is made in a manner similar to that in preparing the cleaning bias table. The result of sampling the monitor voltage is compared with the measured voltage in the cleaning bias table of FIG. 6. A cleaning bias corresponding to the measurement is calculated by linear interpolation of the two points from the cleaning bias table of FIG. 6 stored in the ROM 37*b* (T103). While FIG. 6 is a cleaning bias table for a processing speed of 150 mm/sec, another cleaning bias table can be used for a different processing speed.

The polarity of the constant current output applied to the backup roller 21 to calculate a cleaning bias may either be plus or minus. However, when the polarity of the constant current output is set so as to recover toners adhered more to the secondary transfer roller 27, the secondary transfer roller 27 can be cleaned effectively also during calculation of the cleaning bias. In this embodiment, a constant current of +30 μA is applied to the backup roller 21 at the calculation of the cleaning bias. Accordingly, toners of a minus polarity adhered more to the secondary transfer roller 27 can be recovered to the intermediate transfer belt 10 effectively even during the calculation of the cleaning bias.

The cleaning bias calculated in T103 is determined to be a cleaning bias controlled according to the combined resistance of the secondary transfer section (T104). The cleaning bias determined in T104 is applied to the backup roller 21 from the power source 36, with the polarity switched alternately between a plus polarity and a minus polarity. The polarity of the cleaning bias is switched every one cycle of the intermediate transfer belt 10. A plus-polarity toner adhered to the secondary transfer roller 27 is recovered to the intermediate transfer belt 10 by application of a minus-polarity cleaning bias from the first applying section 36*a* to the backup roller 21. A minus-polarity toner adhered to the secondary transfer roller 27 is recovered to the intermediate transfer belt 10 by application of a plus-polarity cleaning bias from the second applying section 36*b* to the backup roller 21.

The returning operation of the color copying machine 1 is made in such a manner that the plus-polarity cleaning bias and the minus-polarity cleaning bias are alternately applied to the backup roller 21 ten times (ten sets) each in twenty cycles of the intermediate transfer belt 10. Thus both of the plus- and minus-polarity toners adhered to the secondary transfer roller 27 are recovered to the intermediate transfer belt 10. When ten sets of application of the cleaning biases to the backup roller 21 are finished, the cleaning operation, or the returning operation, is completed. The color copying machine 1 thus returns to the image forming process possible state.

In this embodiment, the operation of cleaning the secondary transfer roller 27 is performed not only during the returning operation after jam handling but also during a normal image forming process sequence. The cleaning operation is made when a normal image forming process or an image forming process for irregular paper fed from the manual feed mechanism 30 for one sheet of paper ends, and when a test pattern forming process (in which a patch or line image is formed without the sheet of paper to stabilize image quality) ends.

Thus the toner adhered onto the secondary transfer roller 27, such as dispersed toners, fog toner, or toner adhered because the intermediate transfer belt 10 and the secondary transfer roller 27 are adjacent to each other, can be recovered to the intermediate transfer belt 10. In the cleaning operation, the number of applications of the cleaning bias to the backup roller 21 may be reduced to, e.g., about five sets because the toner adhered to the secondary transfer roller 27 is less than that when the sheet of paper jam occurs.

According to this embodiment, the cleaning bias table for the six combined resistances of the secondary transfer section is stored in the ROM 37*b* in advance. At the operation of returning the color copying machine 1, a constant current output is applied from the secondary transfer transformer 136 to the backup roller 21, and the voltage generated at that time is monitored. The result of sampling the monitor voltage is compared with the cleaning bias table to calculate a cleaning bias according to the combined resistance of the secondary transfer section. The calculated plus- and minus-polarity cleaning biases are alternately applied from the power source 36 to the backup roller 21 to thereby recover the toner adhered on the secondary transfer roller 27 to the intermediate transfer belt 10.

Thus the cleaning bias to be applied to the backup roller 21 is corrected according to the combined resistance of the secondary transfer section which is varied with not only by the environment of the color copying machine 1 but also by the condition of use and various factors. Thus the toner adhered on the secondary transfer roller 27 can be recovered without fail to the intermediate transfer belt 10 by the properly corrected cleaning bias. As a result, smudges on the back of the sheet of paper or smudges of images due to the smudges of the secondary transfer roller 27 can be prevented, whereby clean copies or prints are provided.

A constant current of +30 μA is applied at the measurement of the voltage for calculating a cleaning bias, whereby a minus-polarity toner that is adhered more to the secondary transfer roller 27 is effectively recovered to the intermediate transfer belt 10. Accordingly, the secondary transfer roller 27 can be substantially cleaned even during measurement of the voltage.

It is to be understood that the invention is not limited to the above-described embodiment but various modifications can be made within the scope of the invention. For example, the timing of cleaning the transfer member is not limited to that. The number of applications of the cleaning bias to be applied to the transfer member with the polarity being switched can be set to any numbers depending on the amount of toner adhered on the transfer member. Furthermore, the cleaning bias may be applied to either the image bearing member or the transfer member. The number of the combined resistances for the cleaning bias table is not limited to six. Furthermore, in place of the cleaning bias table, a conversion formula or the like for the control member may be used in controlling a cleaning bias for an arbitrary combined resistance.

As has been described in detail, the invention allows appropriate control of a cleaning bias irrespective of changes in the characteristics of the image bearing member and the transfer member at a transfer position due to various factors, thus allowing application of an appropriate cleaning bias to the image bearing member or the transfer member. Thus the toner adhered on the transfer member can be recovered to the image bearing member without fail, whereby the transfer member can be cleaned. Accordingly, a clear image without smudges on the back or images due to the adhered toner can be provided at the next image formation.

What is claimed is:

1. An image forming apparatus comprising:

an image bearing member;

a transfer member opposed to the image bearing member;

a bias applying member that applies a cleaning bias to the transfer member or the image bearing member; and a control member that controls the cleaning bias according to a combined resistance of the image bearing member and the transfer member, the control member comprises a constant-current source that applies a predetermined constant current to the image bearing member or the transfer member when there is no recording medium in a transfer position, and a measuring section that measures voltages generated in the transfer member and the image bearing member when the constant current is applied, and controls the cleaning bias according to the measurement by the measuring section.

2. An image forming apparatus comprising:

an image bearing member;

a transfer member opposed to the image bearing member;

a bias applying member applies a cleaning bias to the image bearing member or the transfer member while switching polarity alternately; and a control member that controls the cleaning bias according to a combined resistance of the image bearing member and the transfer member.

3. The image forming apparatus according to claim 2, wherein the number of times the bias applying member applies the cleaning bias to the image bearing member or the transfer member while switching the polarity alternately is variable.

4. An image forming apparatus comprising:

image bearing means for bearing a toner image;

transfer means for transferring the toner image borne by the image bearing means to a recording medium;

bias applying means for transferring toner adhered to the transfer means to the image bearing means; and control means for controlling cleaning bias to be applied to the bias applying means according to a combined resistance of the image bearing means and the transfer means, the control means comprising a constant-current source that applies a predetermined constant current to the image bearing means or the transfer means when there is no recording medium in a transfer position, and a measuring section for measuring voltages generated in the transfer means and the image bearing means when the constant current is applied, and controls the cleaning bias according to the measurement by the measuring section.

5. An image forming apparatus comprising:

image bearing means for bearing a toner image;

transfer means for transferring the toner image borne by the image bearing means to a recording medium;

bias applying means for transferring toner adhered to the transfer means to the image bearing means applies the cleaning bias to the image bearing means or the transfer means while switching polarity alternately; and control means for controlling cleaning bias to be applied to the bias applying means according to a combined resistance of the image bearing means and the transfer means.

6. The image forming apparatus according to claim 5, wherein the number of times the bias applying means applies the cleaning bias to the image bearing member or the transfer member while switching the polarity alternately is variable.

7. An image forming method comprising:

applying a predetermined constant current to an image bearing member or a transfer member opposed to the image bearing member;

measuring voltages generated in the transfer member and the image bearing member when the constant current is applied and the constant current is applied to the transfer member or the image bearing member when there is no recording medium in a transfer position, and the voltage generated in the transfer member or the image bearing member at that time is measured;

controlling the cleaning bias according to the measurement; and applying the cleaning bias controlled by the controlling to the image bearing member or the transfer member to transfer toner adhered to the transfer member to the image bearing member.

8. An image forming method comprising:

applying a predetermined constant current to an image bearing member or a transfer member opposed to the image bearing member;

measuring voltages generated in the transfer member and the image bearing member when the constant current is applied;

controlling the cleaning bias according to the measurement; and applying the cleaning bias controlled by the controlling for cleaning, the cleaning bias is applied to the image bearing member or the transfer member, with polarity alternately switched to transfer toner adhered to the transfer member to the image bearing member.

9. The image forming method according to claim 8, wherein, for cleaning, the number of times the cleaning bias is applied to the image bearing member or the transfer member, with the polarity alternately switched, is variable.

* * * * *